US009987188B1

(12) United States Patent
Diao

(10) Patent No.: US 9,987,188 B1
(45) Date of Patent: Jun. 5, 2018

(54) METHOD AND SYSTEM FOR BODY WEIGHT SUPPORT

(71) Applicant: Purdue Research Foundation, West Lafayette, IN (US)

(72) Inventor: Xiumin Diao, West Lafayette, IN (US)

(73) Assignee: Purdue Research Foundation, West Lafayette, IN (US)

( * ) Notice: Subject to any disclaimer, the term of this patent is extended or adjusted under 35 U.S.C. 154(b) by 0 days. days.

(21) Appl. No.: 15/592,132

(22) Filed: May 10, 2017

(51) Int. Cl.

| | |
|---|---|
| ***A63B 21/005*** | (2006.01) |
| ***A61H 3/00*** | (2006.01) |
| ***A63B 21/00*** | (2006.01) |
| ***A63B 22/02*** | (2006.01) |
| ***A63B 23/04*** | (2006.01) |
| ***A63B 24/00*** | (2006.01) |
| ***A63B 71/06*** | (2006.01) |

(52) U.S. Cl.
CPC ..... *A61H 3/008* (2013.01); *A63B 21/154* (2013.01); *A63B 21/4009* (2015.10); *A63B 22/02* (2013.01); *A63B 23/0405* (2013.01); *A63B 24/0087* (2013.01); *A63B 71/0622* (2013.01); *A61H 2201/1619* (2013.01); *A61H 2205/10* (2013.01); *A63B 2220/40* (2013.01); *A63B 2220/51* (2013.01); *A63B 2220/803* (2013.01)

(58) Field of Classification Search
CPC ..... A63B 71/0622; A63B 21/4009; A63B 23/0405; A63B 21/154; A63B 24/0087; A63B 2220/51; A63B 2220/803; A63B 2220/40; A63B 22/02; A63B 69/0064; A63B 21/00181; A63B 22/0221; A63B 2220/52; A63B 2024/0093; A63B 2220/18; A61B 5/6892; A61B 5/1036; A61H 3/008; A61H 2205/10; A61H 2201/1619
See application file for complete search history.

(56) References Cited

U.S. PATENT DOCUMENTS

| | | | | | |
|---|---|---|---|---|---|
| 3,408,067 | A | * | 10/1968 | Armstrong | A63B 22/02 434/253 |
| 4,204,673 | A | * | 5/1980 | Speer, Sr. | A63B 22/0012 198/817 |
| 4,423,864 | A | * | 1/1984 | Wiik | A63B 22/0012 434/253 |
| 4,733,858 | A | * | 3/1988 | Lan | A63B 23/1209 482/113 |

(Continued)

OTHER PUBLICATIONS

Lokomat manufacturer: www.beka.ru/php/content.php?id=695 date unknown.

(Continued)

*Primary Examiner* — Garrett Atkinson
(74) *Attorney, Agent, or Firm* — Piroozi-IP, LLC

(57) ABSTRACT

A body weight support (BWS) system is disclosed. The BWS system includes a harness coupled to a plurality of cables, wherein the harness is worn by a subject, an actuator for each of the plurality of cables, each actuator configured to place a tension on a corresponding cable in response to an electrical signal, at least one force sensor configured to provide an electrical signal corresponding to forces applied to the harness, at least one motion sensor configured to provide an electrical signal corresponding to changes in acceleration of the subject, and a controller configured to control the plurality of actuators.

20 Claims, 6 Drawing Sheets

(56) References Cited

U.S. PATENT DOCUMENTS

| | | | | |
|---|---|---|---|---|
| 5,314,390 | A * | 5/1994 | Westing | A63B 21/00178 482/111 |
| 5,830,162 | A * | 11/1998 | Giovannetti | A61B 5/1038 601/23 |
| 6,302,828 | B1 | 10/2001 | Martin et al. | |
| 6,880,487 | B2 * | 4/2005 | Reinkensmeyer | A01K 15/027 119/421 |
| 7,125,388 | B1 * | 10/2006 | Reinkensmeyer | A63B 69/0064 601/5 |
| 7,381,163 | B2 * | 6/2008 | Gordon | A63B 22/02 482/69 |
| 7,462,138 | B2 | 12/2008 | Shetty et al. | |
| 7,621,850 | B2 * | 11/2009 | Piaget | A63B 22/0056 482/54 |
| 8,002,674 | B2 * | 8/2011 | Piaget | A63B 22/0056 482/52 |
| 8,550,962 | B2 * | 10/2013 | Piaget | A63B 22/0056 482/52 |
| 2017/0027803 | A1 * | 2/2017 | Agrawal | A61B 5/6828 |

OTHER PUBLICATIONS

Hesse S., A Mechanized Gait Trainer for Rehabilitation of Gait, Journal of Rehabilitation and Development, vol. 37, No. 6, 2000.

Peurala S.H., Rehabilitation of Gait in Chronic Stroke Patients, Ph.D. Dissertation, Dept. of Neurology, Univ. of Kuopio, Finland, 2005.

Hidler J.M., et al., Advances in the Understanding and Treatment of Stroke Impairment Using Robotic Devices, Top Stroke Rehabilitation, vol. 12, No. 2, pp. 21-33, 2005.

Dobkin B.H, Overview of Treadmill Locomotor Training with Partial Body Weight Support: A Neurophysiology Sound Approach Whose Time Has Come for Randomized Clinical Trials, Neurorehabil and Neural Repair, vol. 13, pp. 157-165, 1999.

Jezernik S., et al., Automatic Gait-Pattern Adaptation Algorithms for Rehabilitation with a 4-dof Robotic Orthosis, IEEE Trans. on Robotics and Automation, vol. 20, No. 3, pp. 574-582, 2004.

Bernhardt M., et al., Hybrid Force-Position Control Yields Cooperative Behavior of the Rehabilitation Robot LOKOMAT, Proc. of IEEE Int. Conf. on Rehabilitation Robotics, Chicago, IL, pp. 536-539, 2005.

Bertos G.A., et al., The Vertical Mechanical Impedance of the Locomotor System During Human Walking with Applications in Rehabilitation, Proc. of the IEEE Int. Conf. on Rehabilitation Robotics, Chicago, IL, pp. 380-383, 2005.

Ma O., et al., Dynamically Removing Partial Body Mass using Acceleration Feedback for Neutral Training, Proc. of the IEEE Int. Conf. on Rehabilitation Robotics (ICORR 2007), Noordwijk, Netherlands, pp. 1102-1107, 2007.

Diao, Study of Cable Robots for Hardware-in-the-Loop Contact Dynamics Simulation, PhD Thesis, New Mexico State Univ., pp. 117-134, 2007.

* cited by examiner

METHOD AND SYSTEM FOR BODY WEIGHT SUPPORT

TECHNICAL FIELD

The present disclosure generally relates to methods and systems that assist a person in developing skills and in particular to methods and systems for supporting body weight, inter alia, gait rehabilitation.

BACKGROUND

This section introduces aspects that may help facilitate a better understanding of the disclosure. Accordingly, these statements are to be read in this light and are not to be understood as admissions about what is or is not prior art.

There are millions of individuals in the U.S. who currently experience walking disabilities frequently as a result of spinal cord and brain injuries such as stroke. The prevalence of spinal cord and brain injuries is expected to increase in the future due to the increasing aging population. Although medical care for spinal cord and brain injuries has been improving and death rates have been decreasing, many survivors still remain disabled. Walking disability remains the most frequent impairment resulting from spinal cord and brain injuries. Healthcare research has provided strong evidence that many survivors of spinal cord and brain injuries can benefit from performing repetitive gait rehabilitation training.

In addition, there are situations in which an athlete or a hobbyist desires to improve their skills in various sports or activities, e.g., a skier wishes to improve her skills on the ski slope but indoors. In such situations, a system that can assist in simulating the respective environment, e.g., skiing down a slope, can be beneficial.

While subjects with walking disabilities caused by spinal cord and brain injuries can benefit from repetitive gait rehabilitation training (or athletes and gaming enthusiasts benefiting from a training program or entertainment system), translating this concept to practice is frequently challenging. During such a training, the functionally-impaired leg or legs are not capable of fully supporting the entire body weight of the subject, especially at the early stage of the gait training process when the legs are not yet sufficiently strong to support a subject's full body weight. Similarly, it is difficult to introduce force input to an athlete's entire torso and legs or to a gaming enthusiast. To overcome this challenge, researchers and rehabilitation professionals have developed various body weight support (BWS) systems to reduce the subject's body weight, so that s/he can still walk, even with functionally-impaired legs. The primary function of a BWS system is to reduce the body weight of the subject so that he or she can walk with disabled legs during training without the burden of carrying the entire body-weight.

BWS systems are commonly found as cable-suspended BWS systems. The most commonly used approach for reducing subject's body weight is to use a cable suspended in the vertical direction, as shown in FIG. 6. The cable can be controlled either passively by connecting to a counter weight or actively by connecting to an actuator. For a cable-suspended passive BWS system, the subject's body is usually suspended by a counter weight using a cable passing through a pulley. A desirable feature of such a system would be that the subject would sense a reduced weight equal to the counter weight; however, such a cable suspended passive counter-weight mechanism has drawbacks from a dynamics point of view. For example, in an ascending phase, the subject with a body weight of $m_p$ will feel a larger weight than expected due to the relative weightlessness of the counter weight ($m_w$). In particular, if the upward acceleration of the subject's body ($a_p$) is larger than gravity (g), the subject will feel all his or her own weight as if there is no counter weight, because the cable becomes slack (i.e., no tension) in this case. In the descending phase, the counter-weight balance system will effectively balance some or all of the subject's weight. However, the system will tend to overly balance the subject's weight because of the inertia force on the counter weight. In other words, the cable-suspended counter-weight BWS system balances too much of the subject's weight in the descending phase while it balances too little in the ascending phase, as long as the subject's body has a nonzero acceleration in the vertical direction. These undesirable effects are more significant when the leg movement of the subject is irregular, which usually happens in the early stage of a gait rehabilitation training process in which the regular gait has not yet resumed. This is because an irregular movement is associated with more significant transient dynamics, and thus more inertia force on the subject. Another drawback is that the counter weight has to be manually adjusted in order to provide selective counterweights during the rehabilitations process which makes it exceptionally challenging to automatically adjust the counter weight during the actual training.

To overcome the drawbacks of cable-suspended passive BWS systems, researchers and professionals have proposed actively-controlled cable-suspended BWS systems for gait rehabilitation training. For an actively-controlled cable-suspended BWS system, the subject's body is usually suspended through a cable which is connected to an actuator. The actuator is usually designed to reel cable in and out to effectively provide body weight support in the vertical direction. In both the ascending and descending phases of walking, the cable is actively controlled to provide a perfect force in the vertical direction in order to dynamically compensate, not only part of the body weight, but also the corresponding inertia force during walking. By replacing the counter weight with an actively-controlled force (tension in the cable), an actively-controlled cable-suspended BWS system makes the subject feel having a reduced body weight equal to the prescribed amount specified by the rehabilitation health care professional.

However, current active BWS systems suffer from forces that the subject may experience in directions other than the vertical direction. For example, while the counterweight or active cable management provide counterweight in the vertical directions, such systems do not provide any assistance in the X or Y directions in a Cartesian coordinate system. These forces can result in significant amount of instability for the subject. Also, for an athlete's training program or a gaming enthusiast entertainment system, providing forces only in the vertical or Z-direction is insufficient to achieve the desired results.

Furthermore, even in available active systems, these systems are designed to provide a negative weight to counter the subject's weight. In situations where a sudden positive weight is needed, e.g., to simulate a fall, or a sudden drop, the current systems are not capable of providing such selectivity.

Therefore, there is an unmet need for a novel method and system that can provide selective positive and negative counterweight forces to a subject during gait rehabilitation and other situations.

SUMMARY

A body weight support (BWS) system is disclosed. The BWS system includes a harness coupled to a plurality of cables, wherein the harness is worn by a subject. The BWS system also includes an actuator for each of the plurality of cables, each actuator configured to place a tension on a corresponding cable in response to an electrical signal. The BWS system also includes at least one force sensor configured to provide an electrical signal corresponding to forces applied to the harness. The BWS system also includes at least one motion sensor configured to provide an electrical signal corresponding to changes in acceleration of the subject. Furthermore, the BWS system includes a controller configured to control the plurality of actuators according to one of two modes: i) a steady state body weight to be algebraically added to or removed from the subject by calculating instantaneous tensions to be placed on each of the plurality of the cables in accordance with a user's input data, and ii) a transient body weight to be algebraically added to or removed from the subject by calculating instantaneous tensions to be placed on each of the plurality of the cables in accordance with a predetermined dataset. The controller receives the electrical signal from the at least one force sensor, the electrical signal from the at least one motion sensor, and data associated with one of the two modes (i) and (ii).

A method of providing body weight support (BWS) is disclosed. The method includes the step of providing a harness coupled to a plurality of cables, wherein the harness is worn by a subject. The method also includes activating an actuator for each of the plurality of cables, each actuator configured to place a tension on a corresponding cable in response to an electrical signal. The method further includes sensing forces applied to the harness by at least one force sensor configured to provide an electrical signal corresponding to the sensed forces. Additionally, the method includes measuring acceleration of the subject by at least one motion sensor configured to provide an electrical signal corresponding to changes in the subject's acceleration. The method also includes controlling each of the actuators according to one of two modes: i) a steady state body weight to be algebraically added to or removed from the subject by calculating instantaneous tensions to be placed on each of the plurality of the cables in accordance with a user's input data, and ii) a transient body weight to be algebraically added to or removed from the subject by calculating instantaneous tensions to be placed on each of the plurality of the cables in accordance with a predetermined dataset. The controller receives the electrical signal from the at least one force sensor, the electrical signal from the at least one motion sensor, and data associated with one of the two modes (i) and (ii).

DETAILED DESCRIPTION

Figure 1:
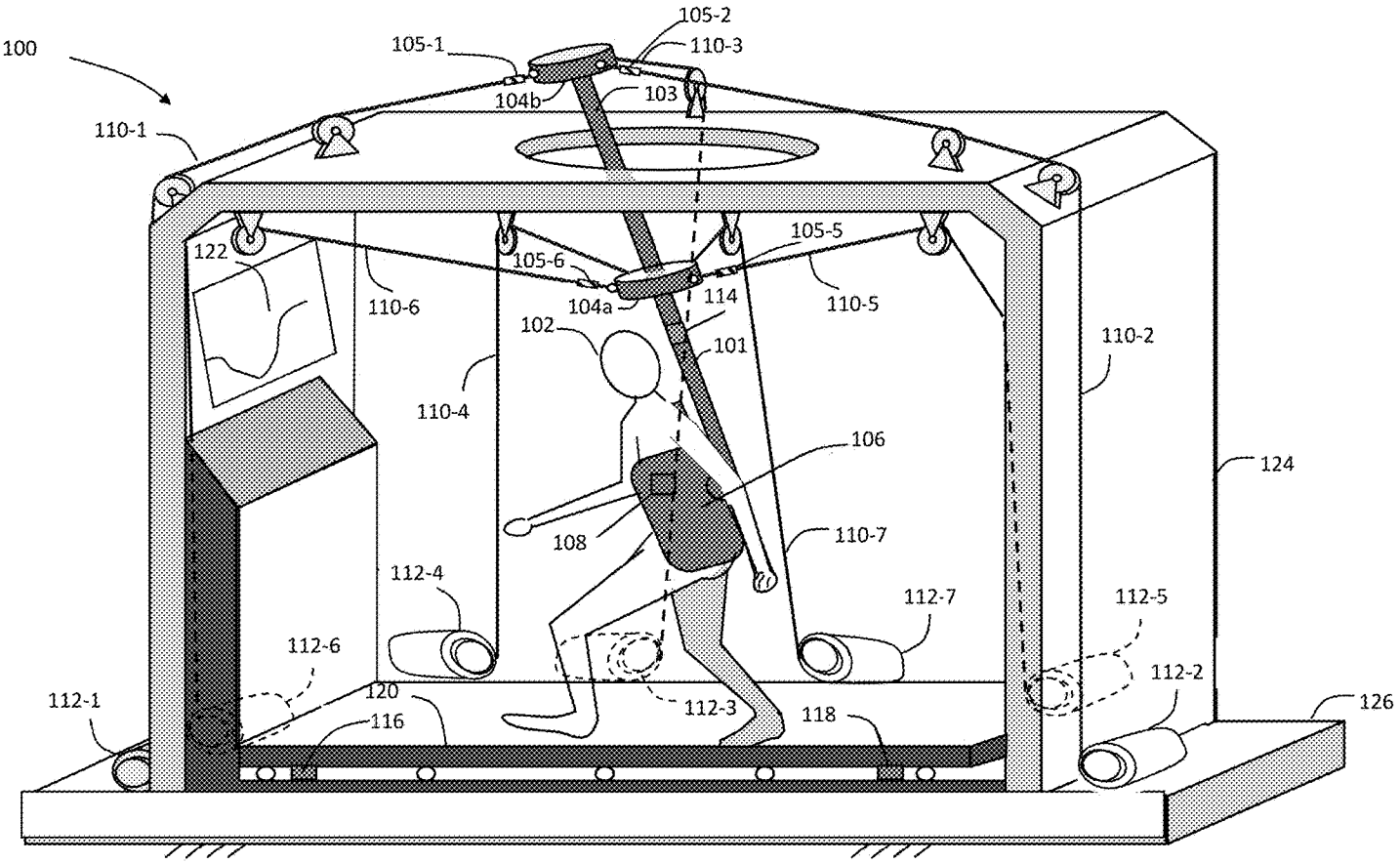
FIG. 1 is a schematic drawing of a body weight support (BWS) system, according to one embodiment of the present disclosure, including a number of actuators.

For the purposes of promoting an understanding of the principles of the present disclosure, reference will now be made to the embodiments illustrated in the drawings, and specific language will be used to describe the same. It will nevertheless be understood that no limitation of the scope of this disclosure is thereby intended.

In the present disclosure, the term "about" can allow for a degree of variability in a value or range, for example, within 10%, within 5%, or within 1% of a stated value or of a stated limit of a range.

In the present disclosure, the term "substantially" can allow for a degree of variability in a value or range, for example, within 90%, within 95%, or within 99% of a stated value or of a stated limit of a range.

A novel method and system that can provide selective positive and negative counterweight forces to a subject during gait rehabilitation and other situations is provided. Referring to FIG. 1, a schematic drawing of a body weight support (BWS) system 100, according to one embodiment of the present disclosure, is shown. The BWS system 100 includes support beam 101 supporting a subject 102 and terminating at a first and second support disks 104*a* and 104*b*, housing load cells 105-1-105-7. The load cells 105-1-105-7 can also be integrated into each of the cables (discussed below), preferably near the end of the cables terminating at the support disks 104*a* and 104*b*. A load cell is intended to measure the tension in a cable. Therefore, each cable is to have one load cell. The subject 102 is supported by a harness 106 which is worn on the subject's torso or other parts of the subject 102 as appropriate for the training or rehabilitation program. The word harness in the present disclosure simply refers to an apparatus that is coupled to the subject 102 and which can support or exert forces to the subject in various directions. The word support in the present disclosure refers to either removing weight from the subject for a steady-state or instantaneous negative weight compensation with applying a force with X-Y-Z directional components, or for exerting a steady state or instantaneous positive weight compensation with applying a force with X-Y-Z directional components upon the subject where the subject feels a weight higher than his/her own weight. The harness 106 includes an accelerometer 108, capable of providing acceleration vectors in three directions $a_x$, $a_y$, and $a_z$ in a Cartesian coordinate system, or as appropriate in cylindrical or spherical coordinate systems. It should also be understood that the accelerometer can be replaced by motion sensors capable of measuring motion such as position, velocity and calculate acceleration, accordingly, as known to a person having ordinary skill in the art. While only one accelerometer 108 is depicted in FIG. 1, it should be appreciated that more than one accelerometer may be used to ascertain acceleration of different parts of the subject's body.

The harness 106 is supported by seven cables 110-1, 110-2, 110-3, 110-4, 110-5, 110-6, and 110-7 to provide active control in six degrees of freedom. Each of the cables 110-1, 110-2, and 110-3 are coupled to the support disk 104*b* at one end and to a respective actuator 112-1, 112-2, 112-3 at a second end. In between the support disk 104*b* and the respective actuators 112-1-112-3, the cables 110-1-110-3 are further supported by pulleys (not called out to avoid over-cluttering FIG. 1) or other devices known to a person having ordinary skill in the art. Each of the cables 110-4, 110-5, 110-6, and 110-7 are coupled to the support disk 104*a* at one end and to a respective actuator 112-4, 112-5, 112-6, and 112-7 at a second end. In between the support disk 104*a* and the respective actuators 112-4-112-7, the cables 110-4-110-7 are further supported by pulleys (not called out to avoid over-cluttering FIG. 1) or other devices known to a person having ordinary skill in the art.

While seven cables 110-1-110-7 and seven actuators 112-1-112-7 are shown in FIG. 1 to generate six degrees of freedom, a smaller number of cables and actuators can be used in other embodiments (not shown) for a reduced number of degrees of freedom. For example, for a three degrees of freedom implementation, four cables and four actuators are needed. Generally, for n degrees of freedom, n+1 cables and actuators are needed. In one embodiment, the angular relationship between the cables 110-1-110-7 in each subgroup (i.e., cables 110-1-110-3 and 110-4-110-7, respectively), cab be substantially the same (i.e., cables 110-1-110-3 each separated by about 120°, and cables 110-4-110-7 each separated by about 90°). However, other angular relationship can also be implemented as long the desired number of degrees of freedom can be realized.

The BWS system 100, further includes a force sensor 114 disposed in the support beam 101. Additionally, force sensors 116 and 118 are disposed between treadmill 120 and base 126 of enclosure 124. While two force sensors (116 and 118) are depicted in FIG. 1 between the treadmill and the base 126, there can be four force sensors, one on each corner of the treadmill. All the force sensors are typically 3-axis force sensors (although sensors with more or less axes are also possible). Each of them can measure the force in three orthogonal directions. These force sensors provide force measurements at various positions. For example, the force sensor 114 in the support beam 101 provides $F_X$, $F_y$, and $F_z$ vectors in X, Y, and Z directions representing those force vectors being applied to the support beam 101. The treadmill 120 can be a typical treadmill operating in horizontal or inclined positions with respect to the base 126; or alternatively, a treadmill that can move in all three dimensions (i.e., horizontally, inclined, and laterally) with respect to the base 126. The latter can simulate a shifting landscape. The enclosure 124 is an exemplary enclosure. Other structures can also be implemented.

The BWS system 100 also includes a visual input via a screen 122. The screen 122, provides scenes that the subject 102 can use to determine upcoming situations. The scenes on the screen 122 are controlled by an exemplary data processing system 1000, described in FIG. 5. The screen 122 can be of various sizes and angular disposition with respect to the subject 102 to provide a desirable life-like scene for the subject.

The data processing system 1000 can be configured to control in one or both of two modes: 1) to provide an active control of the actuators 112-1-112-7 such that these actuators maintain a minimum selectable tension on the cables 110-1-110-7, respectively; or 2) to provide an active control of the actuators 112-1-112-7 such that these actuators provide tensions on the cables according to a predetermined dataset, where in both modes (i.e., minimum selectable tension, or a predetermined dataset), the data processing system 1000 takes into account and compensates any disturbance introduced by the subject 102. These disturbances are identified by the accelerometer 108 and the force sensors 114, 116, and 118.

In the case of control based on a predetermined dataset, the data processing system 1000 can be configured to provide visual inputs to the subject 102 based on scenes displayed on the screen 122. In either approach, the BWS system 100 can then be used in a variety of different applications. For example, the BWS system 100 can be used to train astronauts. In such an application, the BWS system 100, can simulate a lower gravity than Earth (e.g., moon's gravity) by controlling the actuators 112-1-112-7 to provide the appropriate amount of tension in the cables 110-1-110-7 such that the astronaut in training experiences a smaller than Earth gravity force, while compensating for any disturbances introduced by the astronaut in X and Y directions (where the Z direction represents gravity). Furthermore, the BWS system 100 can be configured to control the actuators 112-1-112-7 to provide the appropriate amount of tension in the cables 110-1-110-7 in accordance with scenes on the screen 112. There again, the BWS system 100 compensates for any disturbances introduced by the astronaut in X and Y directions (where the Z direction represents gravity).

In another exemplary situation, an athlete can be trained indoors for various sports. For example, a skier can be trained using the BWS system 100. In this type of situation, not only the BWS system 100 controls the actuators 112-1-112-7 to provide tension in cables 110-1-110-7 in accordance with a predetermined dataset for selectively controlling acceleration in X, Y, and Z directions (i.e., providing continuously changing forces to the skier in training in all three directions) in accordance to the scenes provided on the screen 122, but also compensate the control of the actuators 110-1-110-7 as the skier makes movements in any or all three directions thereby generating counter forces in all three directions. This level of dynamic force generation and compensation creates a real-life simulation of skiing down a hill while providing forces to the subject 102.

In addition to controlling actuators 110-1-110-7, the data processing system 1000 is also capable of controlling the treadmill 120 to provide horizontal motion, vertical motion, as well as lateral motion, in accordance with the same modes described above (i.e., minimum selectable tension, or a predetermined dataset) in cooperation with control of the actuators 112-1-112-7. The treadmill 120 can also be replaced with other attachments, e.g., a skier's boots and skis, with corresponding actuators (not shown) also configured to generate forces in the X-Y-Z directions at the feet of the subject 102.

Figure 2:
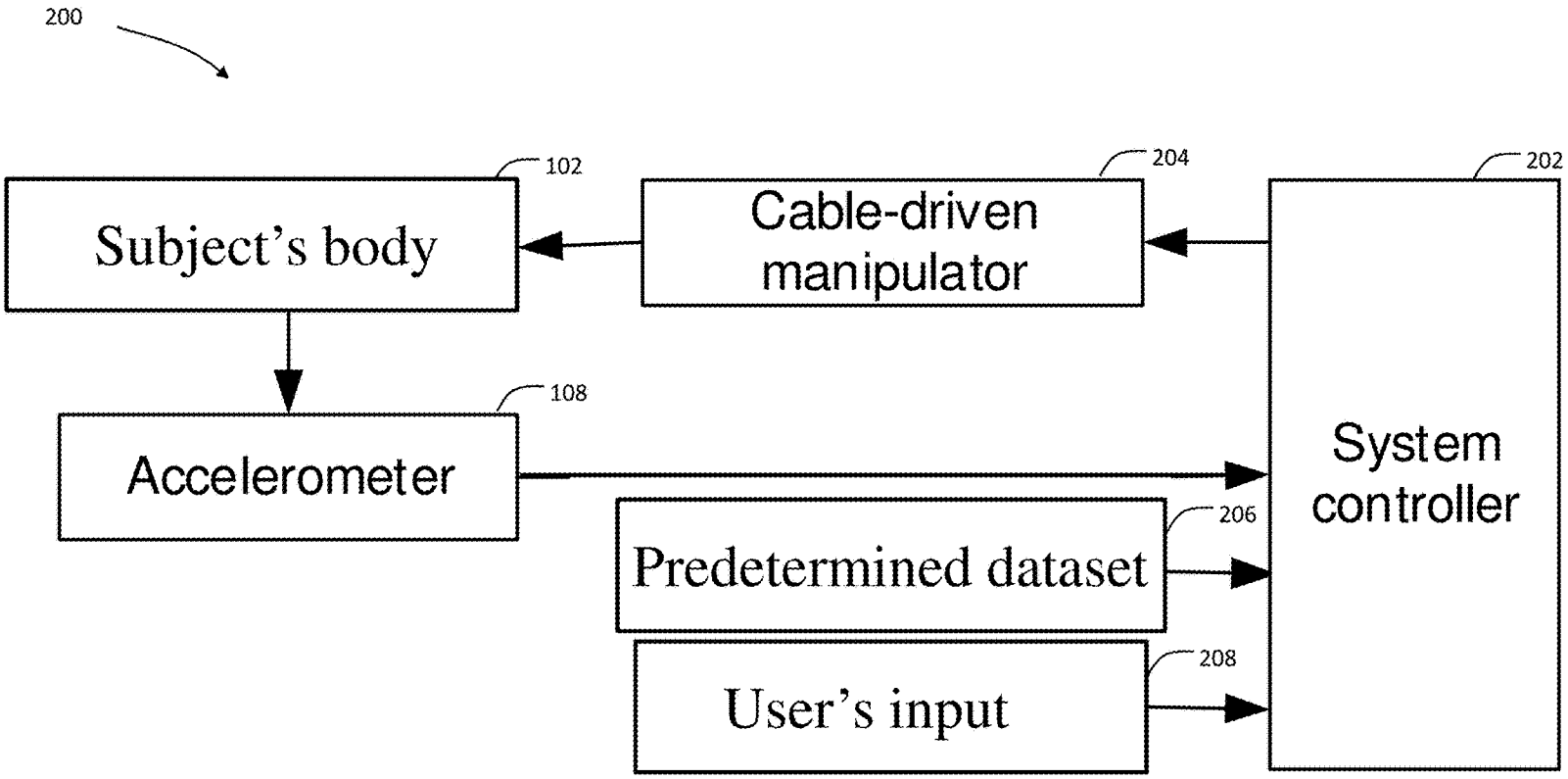
FIG. 2 is a schematic of a control scheme, including a controller for controlling the actuators of FIG. 1.

The data processing system 1000 (shown in FIG. 5), controls the actuators 110-1-110-7 based on a control scheme 200 depicted in FIG. 2. During a training regimen, the acceleration of the subject's body is measured through an accelerometer (e.g., 108 in FIG. 1) coupled to the subject's body. The controller scheme 200 of the data processing system 1000 controls the cable-driven BWS system 100 by calculating the amount of positive/negative body weight support required, based on the subject's body acceleration, a user's input 208, and/or requirements from the predetermined dataset 206. A system controller 202 electronically sends commands to a cable-driven manipulator 204 which provides an appropriate signal to the actuators 110-1-110-7 which deliver the appropriate body weight support. Consequently, the subject's body 102 is supported or acted on by the cable-driven manipulator 204, which is actively controlled using an acceleration-feedback strategy. Acceleration feedback has the advantages of a relatively rapid response because the acceleration of a human body can be measured while the subject is in motion. For example, a subject with a body weight of 70 Kg may be able to support 40 Kg of body weight, based on a diagnosis of a health care professional. If the subject is accelerating upwards with an acceleration of 2 m/s$^2$, then the BWS system will provide a support of (70-40)×(9.8+2)=354 Newtons in the vertical direction, where 9.8 is the magnitude of the gravity acceleration. In other words, the cable-driven BWS system compensates both part of the body mass (30 Kg) and the inertia force of the compensated body mass generated due to the motion of the subject. In this way, the cable-driven BWS system can provide the same dynamic characteristics (i.e., same dynamic response) as if a part of his or her body mass were physically removed. With such a force control capability, the cable-driven BWS system will allow the subject to experience as though he or she were having a reduced body mass dynamically, regardless how he or she moves (e.g., walking, jogging, jumping, etc.) during the training.

Figure 3:
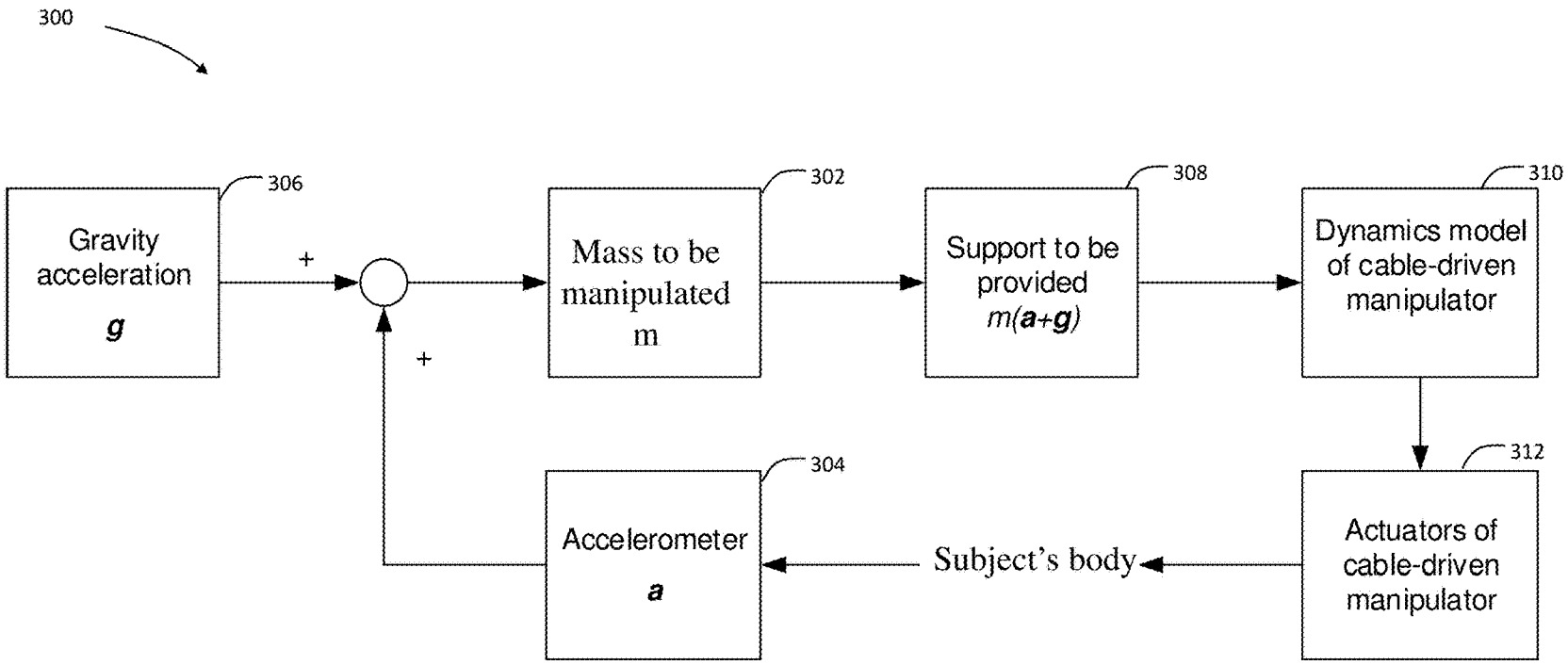
FIG. 3 is a data flowchart associated with data paths controlled by the controller of FIG. 2.

Referring to FIG. 3 a data flowchart 300 is depicted. The mass (m) to be manipulated (a negative number if m is to be negated from the subject, e.g., for situations where the subject cannot support his or her own weight, or to simulate a lighter weight; and a positive number if m is to be added to the subject, e.g., for situations where the subject is to feel a higher weight) is specified by a user as described above (block 302). The acceleration of the subject's body is measured using an accelerometer, denoted as a (block 304), which is a vector with components in all three directions (i.e., $a_x$, $a_y$, and $a_z$). Earth's gravity is denoted as g (block 306). The controller 202 (FIG. 2) calculates m that results in forces to be provided by the cables 110-1-110-7 (FIG. 1) as m(a+g) (block 308). It should be appreciated that this support is a three-dimensional force vector (to provide three-dimensional support for the subject). The dynamics model of the cable-driven manipulator is represented by $J^T f=w$ (block 310), where J is a 7×6 Jacobian matrix of the cable-driven manipulator;

$f$ is a 7×1 vector of calculated cable tensions; and w is a 6×1 force vector (six degrees of freedom) generated by the set of cable tensions represented by $f$.

Replacing the first three force components of w with m(a+g), the set of cable tensions $f$ required to generate the needed support m(a+g) can be determined. For each cable 110-1-110-7 (FIG. 1), the required tension will be compared with its current tension (acquired from the load cells 105-1-105-7 attached to the cable 110-1-110-7). If there is any difference, then the corresponding actuator (112-1-112-7) is actuated (block 312) until the cable tension is changed to the required cable tension. With all cables having achieved the required tensions, the BWS System 100 reaches equilibrium (i.e., providing the correct support). These changes to the actuators are made in real time. The mass to be manipulated (block 302) is determined in accordance of the two modes described above (i.e., minimum selectable tension, or a predetermined dataset), and based on disturbances generated by the subject's movements.

Figure 4:
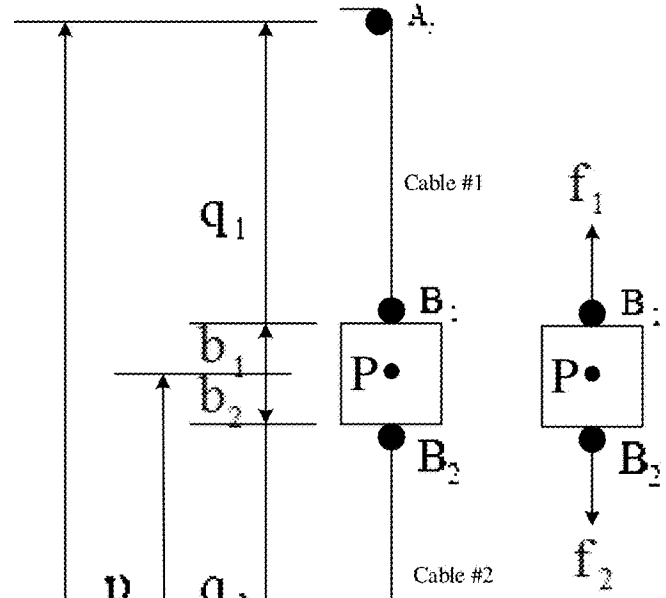
FIG. 4 is a schematic drawing of how a one-dimensional solution is derived.

Referring to FIG. 4, a one-dimensional determination of the $J^T f=w$ is provided. $A_1$ and $B_1$ are the two attaching points of cable #1 (e.g., 110-1) on a corresponding actuator and harness 106, respectively. $A_2$ and $B_2$ are the two attaching points of cable #2 on a corresponding actuator and harness 106, respectively. The positions of the four attaching points are represented by $a_1$,$a_2$,$b_1$ and $b_2$, respectively. The center of mass of the harness (with the subject therein) is marked as the reference point, denoted by point P. The length of cable #1 is represented by $q_1$ and the length of cable #2 is represented by $q_2$.

The position of the reference point P can be described as $$p=a_1-q_1-b_1 \tag{1}$$

$$p=a_2-q_2-b_2 \tag{2}$$

Solving $q_1$ from (1) and $q_2$ from (2), one has $$q_1=a_1-b_1-p \tag{3}$$

$$q_2=a_2-b_2-p \tag{4}$$

Differentiating (3) and (4) with respect to time, one obtains $$\dot{q}_1=-\dot{p} \tag{5}$$

$$\dot{q}_2=-\dot{p} \tag{6}$$

which can be rewritten into the following matrix form $$\dot{q}=J\dot{p} \tag{8}$$

where J denotes the 2×1 Jacobian matrix $$\dot{q}=\begin{bmatrix}\dot{q}_1\\ \dot{q}_2\end{bmatrix} \text{ and } J=\begin{bmatrix}-1\\ -1\end{bmatrix} \tag{9}$$

The Jacobian matrix is a constant matrix for this 1-degree of freedom (DOF) 2-cable manipulator. The dynamics model of the cable manipulator can be written as $$Af=w \tag{10}$$

where $$A\equiv J^T=[-1\quad -1];\ f=\begin{bmatrix}f_1\\ f_2\end{bmatrix} \tag{11}$$

$f_1$ and $f_2$ are cable tensions in cables #1 and #2, respectively. w is the external force (along y axis) exerted on the harness.

The general solution of (10) includes two parts, namely, a homogeneous solution and a particular solution. The homogeneous solution is the solution for $$Af=0 \tag{12}$$

This homogeneous solution can be used to maintain the minimum cable tension. As long as $f_1$ and $f_2$ have the same magnitude but opposite directions, they satisfy (12). The particular solution is the solution of (10) for a particular w. The general solution of (10) can be expressed as $$f=\begin{bmatrix}-0.7071\\ 0.7071\end{bmatrix}\alpha+\begin{bmatrix}-1\\ 0\end{bmatrix}w \tag{12}$$

where $$\begin{bmatrix}-0.7071\\ 0.7071\end{bmatrix}\alpha$$

and $$\begin{bmatrix}-1\\ 0\end{bmatrix}w$$

are the homogeneous solution and the particular solution of (10) can be calculated using numerical processing systems, known to a person having ordinary skill in the art (e.g., MATLAB). $\alpha$ is a scalar to scale the homogeneous solution as needed.

Assuming a subject has a body mass of 100 Kg and the acceleration of gravity is 9.8 m/s$^2$, and a user wants to "take off" 50% of his or her body mass, then the 1-DOF cable-driven BWS system needs to provide a support of 100*9.8*0.5=490 N in the vertical direction. The particular solution of (10) for w=490 N is $$\begin{bmatrix} -1 \\ 0 \end{bmatrix} w = \begin{bmatrix} -490 \\ 0 \end{bmatrix}.$$

Assume the minimum cable tension is 10 N, then $$\alpha = \frac{10}{0.7071} = 14.1423.$$

The homogeneous solution is $$\begin{bmatrix} -0.7071 \\ 0.7071 \end{bmatrix} \alpha = \begin{bmatrix} -10 \\ 10 \end{bmatrix}.$$

Therefore, the general solution of (10) is $f_1$=−10−490=−500 N and $f_2$=10+0=10 N. The forces applied on the end-effector by cables #1 and #2 have opposite directions.

The kinematics notation of a 6-degrees of freedom (DOF)—7-cable manipulator is next described. $A_i$ and $B_i$ are two attaching points of the i$^{th}$ cable on the base (or the corresponding pulley or actuator, respectively, as shown in FIG. 1) and the harness (or the corresponding support disk, as shown in FIG. 1), respectively. The positions of the attaching points are represented by vectors $a_i$ and $b_i$, respectively. $a_i$ is a constant vector in a reference frame mounted on the base and $b_i$ is a constant vector in a reference frame mounted on the harness. $q_i \epsilon R^3$, is the vector along the ith cable and has the same length as the cable (between attaching points $A_i$ and $B_i$). The length of the ith cable is represented by scalar $q_i \cdot u_i$ is the unit vector (dimensional vector) along the ith cable. Based on the kinematics notation, the position of the harness can be described as $$p=a_i-q_i-b_i \text{ for } i=1,2,\ldots,7$$

from which one has $$q_i^2=[a_i-p-b_i]^T[a_i-p-b_i] \text{ for } i=1,2,\ldots,7$$

Differentiating the latter with respect to time, and then assembling the seven resulting equations into matrix form, the following matrix-based equation is achieved:

$$\dot{q}=Jt$$

where vector $\dot{p}$ represents the linear velocity of the harness; vector $\omega$ is the angular velocity of the harness; and t represents the twist vector in $R^6$ which includes both the linear and angular velocities of the harness. J is the 7×6 Jacobian matrix of the cable manipulator The dynamics model of such a 6-DOF 7-cable manipulator can be written as:

$$Af=w$$

where $$A=J^T$$

$$f=[f_1 f_2 \ldots f_7]^T$$

where $f_i$ (i=1, 2, . . . , 7) is the cable tension in the i$^{th}$ cable. w is the resultant external forces and torques exerted on the harness.

The general solution of Af=w includes two part, namely, a homogeneous solution and a particular solution. The homogeneous solution is the solution for $$Af=0$$

This homogeneous solution can be used to maintain the minimum cable tension. The particular solution is the solution of Af=w for a particular w. The general solution of Af=w can be expressed as $$f=f_0\alpha+f_w$$

where $f_0$ is the homogeneous solution and $f_w$ is a particular solution of Af=w. $\alpha$ is a scalar to scale the homogeneous solution as needed (e.g., to keep all cables in tension or to achieve a minimum tension requirement for all cables).

Figure 5:
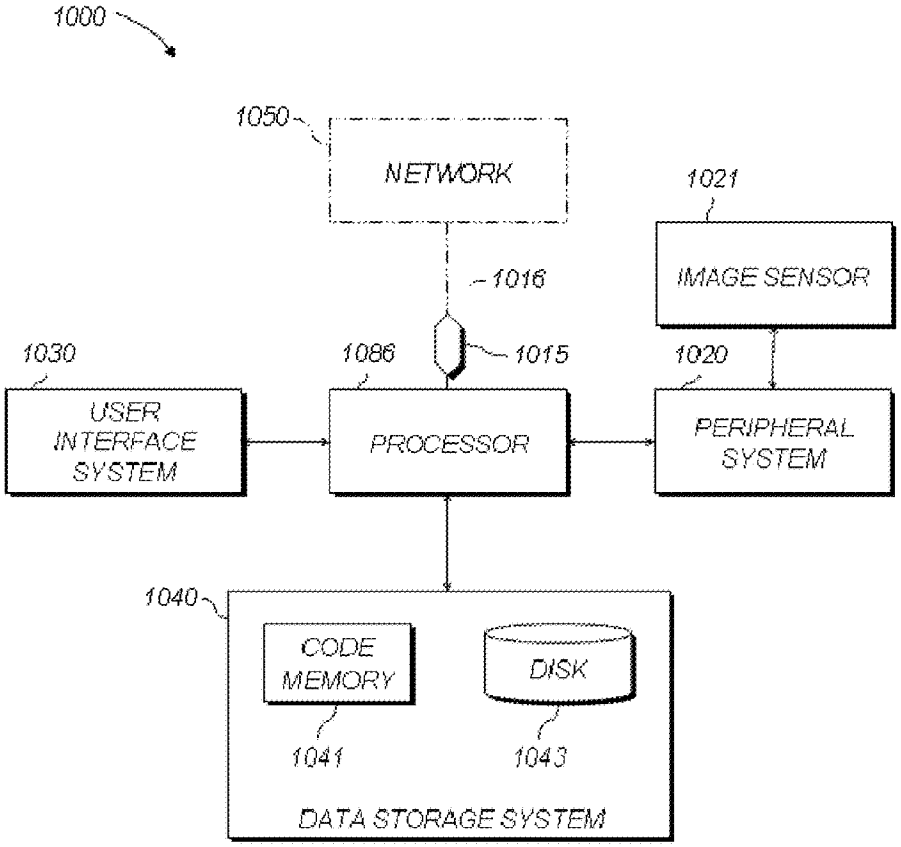
FIG. 5 is a high-level diagram showing the components of the exemplary data-processing system.
Figure 6:
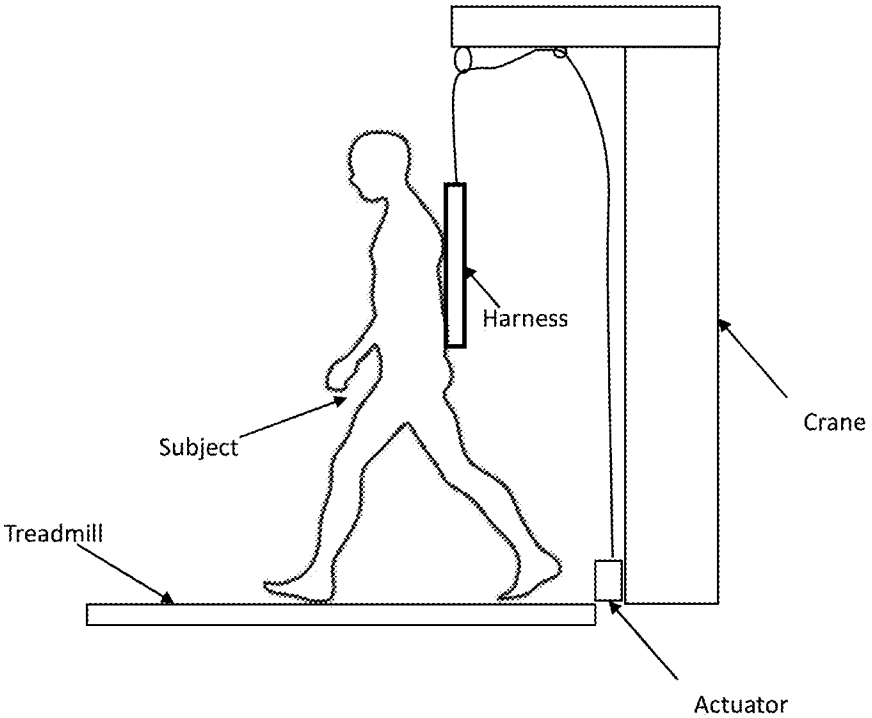
FIG. 6 (Prior Art)
FIG. 6 is a prior art approach for a cable-driven BWS system.

Referring to FIG. 5, a high-level diagram showing the components of the exemplary data-processing system 1000 for analyzing data and performing other analyses described herein, and related components. The system includes a processor 1086, a peripheral system 1020, a user interface system 1030, and a data storage system 1040. The peripheral system 1020, the user interface system 1030 and the data storage system 1040 are communicatively connected to the processor 1086. Processor 1086 can be communicatively connected to network 1050 (shown in phantom), e.g., the Internet or a leased line, as discussed below. The imaging described in the present disclosure may be obtained using imaging sensors 1021 and/or displayed using display units (included in user interface system 1030) which can each include one or more of systems 1086, 1020, 1030, 1040, and can each connect to one or more network(s) 1050. Processor 1086, and other processing devices described herein, can each include one or more microprocessors, microcontrollers, field-programmable gate arrays (FPGAs), application-specific integrated circuits (ASICs), programmable logic devices (PLDs), programmable logic arrays (PLAs), programmable array logic devices (PALS), or digital signal processors (DSPs).

Processor 1086 can implement processes of various aspects described herein. Processor 1086 can be or include one or more device(s) for automatically operating on data, e.g., a central processing unit (CPU), microcontroller (MCU), desktop computer, laptop computer, mainframe computer, personal digital assistant, digital camera, cellular phone, smartphone, or any other device for processing data, managing data, or handling data, whether implemented with electrical, magnetic, optical, biological components, or otherwise. Processor 1086 can include Harvard-architecture components, modified-Harvard-architecture components, or Von-Neumann-architecture components.

The phrase "communicatively connected" includes any type of connection, wired or wireless, for communicating data between devices or processors. These devices or processors can be located in physical proximity or not. For example, subsystems such as peripheral system 1020, user interface system 1030, and data storage system 1040 are shown separately from the data processing system 1086 but can be stored completely or partially within the data processing system 1086.

The peripheral system 1020 can include one or more devices configured to provide digital content records to the processor 1086. For example, the peripheral system 1020 can include digital still cameras, digital video cameras, cellular phones, or other data processors. The processor 1086, upon receipt of digital content records from a device in the peripheral system 1020, can store such digital content records in the data storage system 1040.

The user interface system 1030 can include a mouse, a keyboard, another computer (connected, e.g., via a network or a null-modem cable), or any device or combination of devices from which data is input to the processor 1086. The user interface system 1030 also can include a display device, a processor-accessible memory, or any device or combination of devices to which data is output by the processor 1086. The user interface system 1030 and the data storage system 1040 can share a processor-accessible memory.

In various aspects, processor 1086 includes or is connected to communication interface 1015 that is coupled via network link 1016 (shown in phantom) to network 1050. For example, communication interface 1015 can include an integrated services digital network (ISDN) terminal adapter or a modem to communicate data via a telephone line; a network interface to communicate data via a local-area network (LAN), e.g., an Ethernet LAN, or wide-area network (WAN); or a radio to communicate data via a wireless link, e.g., WiFi or GSM. Communication interface 1015 sends and receives electrical, electromagnetic or optical signals that carry digital or analog data streams representing various types of information across network link 1016 to network 1050. Network link 1016 can be connected to network 1050 via a switch, gateway, hub, router, or other networking device.

Processor 1086 can send messages and receive data, including program code, through network 1050, network link 1016 and communication interface 1015. For example, a server can store requested code for an application program (e.g., a JAVA applet) on a tangible non-volatile computer-readable storage medium to which it is connected. The server can retrieve the code from the medium and transmit it through network 1050 to communication interface 1015. The received code can be executed by processor 1086 as it is received, or stored in data storage system 1040 for later execution.

Data storage system 1040 can include or be communicatively connected with one or more processor-accessible memories configured to store information. The memories can be, e.g., within a chassis or as parts of a distributed system. The phrase "processor-accessible memory" is intended to include any data storage device to or from which processor 1086 can transfer data (using appropriate components of peripheral system 1020), whether volatile or non-volatile; removable or fixed; electronic, magnetic, optical, chemical, mechanical, or otherwise. Exemplary processor-accessible memories include but are not limited to: registers, floppy disks, hard disks, tapes, bar codes, Compact Discs, DVDs, read-only memories (ROM), erasable programmable read-only memories (EPROM, EEPROM, or Flash), and random-access memories (RAMS). One of the processor-accessible memories in the data storage system 1040 can be a tangible non-transitory computer-readable storage medium, i.e., a non-transitory device or article of manufacture that participates in storing instructions that can be provided to processor 1086 for execution.

In an example, data storage system 1040 includes code memory 1041, e.g., a RAM, and disk 1043, e.g., a tangible computer-readable rotational storage device such as a hard drive. Computer program instructions are read into code memory 1041 from disk 1043. Processor 1086 then executes one or more sequences of the computer program instructions loaded into code memory 1041, as a result performing process steps described herein. In this way, processor 1086 carries out a computer implemented process. For example, steps of methods described herein, blocks of the flowchart illustrations or block diagrams herein, and combinations of those, can be implemented by computer program instructions. Code memory 1041 can also store data, or can store only code.

Various aspects described herein may be embodied as systems or methods. Accordingly, various aspects herein may take the form of an entirely hardware aspect, an entirely software aspect (including firmware, resident software, micro-code, etc.), or an aspect combining software and hardware aspects. These aspects can all generally be referred to herein as a "service," "circuit," "circuitry," "module," or "system."

Furthermore, various aspects herein may be embodied as computer program products including computer readable program code stored on a tangible non-transitory computer readable medium. Such a medium can be manufactured as is conventional for such articles, e.g., by pressing a CD-ROM. The program code includes computer program instructions that can be loaded into processor 1086 (and possibly also other processors), to cause functions, acts, or operational steps of various aspects herein to be performed by the processor 1086 (or other processor). Computer program code for carrying out operations for various aspects described herein may be written in any combination of one or more programming language(s), and can be loaded from disk 1043 into code memory 1041 for execution. The program code may execute, e.g., entirely on processor 1086, partly on processor 1086 and partly on a remote computer connected to network 1050, or entirely on the remote computer.

While the BWS system 100 (FIG. 1) shows seven cables 110-1-110-7 coupled to the harness 106 and each terminating at a corresponding one of seven actuators 112-1-112-7 in order to generate a six degrees of freedom control for the harness 106 and the subject, it is well within the scope of the present disclosure to have control based on a smaller or larger number of degrees of freedom over the harness 106. In one exemplary embodiment (not shown), the number of degrees of freedom is 1 resulting in two cables and two actuators. In another exemplary embodiment (not shown), the number of degrees of freedom is 2 resulting in three cables and three actuators. In general, it is within the scope of the present disclosure to establish control over the harness 106 based on N degrees of freedom using a minimum of N+1 cables and N+1 actuators.

Those having ordinary skill in the art will recognize that numerous modifications can be made to the specific implementations described above. The implementations should not be limited to the particular limitations described. Other implementations may be possible.

The invention claimed is:

1. A body weight support (BWS) system, comprising:

a harness coupled to a plurality of cables, wherein the harness is configured to be worn by a subject;

an actuator for each of the plurality of cables, each actuator configured to place a tension on a corresponding cable in response to an electrical signal;

at least one force sensor configured to provide an electrical signal corresponding to forces applied to the harness;

at least one motion sensor configured to provide an electrical signal corresponding to changes in acceleration of the subject; and a controller configured to control the plurality of actuators according to one of two modes: i) a steady state body weight to be algebraically added to or removed from the subject by calculating instantaneous tensions to be placed on each of the plurality of the cables in accordance with the subject's input data, and ii) a transient body weight to be algebraically added to or removed from the subject by calculating instantaneous tensions to be placed on each of the plurality of the cables in accordance with a predetermined dataset, wherein the controller is configured to receive the electrical signal from the at least one force sensor, the electrical signal from the at least one motion sensor, and data associated with one of the two modes (i) and (ii).

2. The BWS system of claim 1, further comprising:

a screen configured to display scenes corresponding to the predetermined dataset.

3. The BWS system of claim 1, wherein the controller controls forces applied to the harness based on N degrees of freedom, and at least N+1 cables.

4. The BWS system of claim 3, wherein the controller is configured to solve for tension on each of the plurality of cables based on $J^T f=w$, wherein J is a N+1×N Jacobian matrix;

$f$ is a N+1×1 vector of calculated cable tensions; and w is a N×1 force vector.

5. The BWS system of claim 4, wherein N is 6.

6. The BWS system of claim 4, wherein N is 3.

7. The BWS system of claim 4, wherein N is 1.

8. The BWS system of claim 1, further comprising:

a treadmill configured to move in each of X-Y-Z directions, in accordance with a prescribed rate of motion or in accordance with mode (ii).

9. The BWS system of claim 8, further comprising:

one or more force sensors disposed between base of the treadmill and a base of an enclosure housing the BWS system, to provide forces in at least the vertical direction.

10. The BWS system of claim 1, further comprising:

a foot apparatus configured to be worn by the subject, wherein the apparatus configured to move in each of X-Y-Z directions, in accordance with a prescribed rate of motion or in accordance with mode (ii).

11. A method of providing a body weight support (BWS), comprising:

providing a harness coupled to a plurality of cables, wherein the harness is worn by a subject;

activating an actuator for each of the plurality of cables, each actuator configured to place a tension on a corresponding cable in response to an electrical signal;

sensing forces applied to the harness by at least one force sensor configured to provide an electrical signal corresponding to the sensed forces;

measuring acceleration of the subject by at least one motion sensor configured to provide an electrical signal corresponding to changes in the subject's acceleration; and controlling each of the actuators according to one of two modes: i) a steady state body weight to be algebraically added to or removed from the subject by calculating instantaneous tensions to be placed on each of the plurality of the cables in accordance with the subject's input data, and ii) a transient body weight to be algebraically added to or removed from the subject by calculating instantaneous tensions to be placed on each of the plurality of the cables in accordance with a predetermined dataset, wherein the controller receives the electrical signal from the at least one force sensor, the electrical signal from the at least one motion sensor, and data associated with one of the two modes (i) and (ii).

12. The method of claim 11, further comprising:

providing a screen configured to display scenes corresponding to the predetermined dataset.

13. The method of claim 11, wherein the controller controls forces applied to the harness based on N degrees of freedom, and at least N+1 cables.

14. The method of claim 13, wherein the controller solves for tension on each of the plurality of cables based on $J^T f=w$, wherein J is a N+1×N Jacobian matrix;

$f$ is a N+1×1 vector of calculated cable tensions; and w is a N×1 force vector.

15. The method of claim 14, wherein N is 6.

16. The method of claim 14, wherein N is 3.

17. The method of claim 14, wherein N is 1.

18. The method of claim 11, further comprising:

providing a treadmill configured to move in each of X-Y-Z directions, in accordance with a prescribed rate of motion or in accordance with mode (ii).

19. The method of claim 18, further comprising:

providing one or more force sensors disposed between base of the treadmill and a base of an enclosure housing the BWS system to provide forces in at least the vertical direction.

20. The method of claim 11, further comprising:

providing a foot apparatus configured to be worn by the subject, wherein the apparatus configured to move in each of X-Y-Z directions, in accordance with a prescribed rate of motion or in accordance with mode (ii).

* * * * *